US007300323B1

(12) United States Patent
Bandyopadhyay

(10) Patent No.: US 7,300,323 B1
(45) Date of Patent: Nov. 27, 2007

(54) LINEAR ACTUATOR FOR FLAPPING HYDROFOIL

(75) Inventor: Promode R. Bandyopadhyay, Middletown, RI (US)

(73) Assignee: The United States of America represented by the Secretary of the Navy, Washington, DC (US)

( * ) Notice: Subject to any disclaimer, the term of this patent is extended or adjusted under 35 U.S.C. 154(b) by 63 days.

(21) Appl. No.: 11/447,512

(22) Filed: May 30, 2006

(51) Int. Cl.
*B63H 1/30* (2006.01)

(52) U.S. Cl. ..... 440/13

(58) Field of Classification Search ..... 440/13–15
See application file for complete search history.

(56) References Cited

U.S. PATENT DOCUMENTS 3,874,320 A * 4/1975 Wood ..... 440/15
3,994,253 A 11/1976 Mathewson
4,622,913 A 11/1986 Williams
4,776,821 A 10/1988 DuPont
5,401,196 A 3/1995 Triantafyllou et al.
5,673,645 A * 10/1997 Bandyopadhyay ..... 114/312
5,740,750 A * 4/1998 Triantafyllou et al. .... 114/67 R
5,860,384 A 1/1999 Castillo
5,975,228 A * 11/1999 Parfitt ..... 180/69.21
6,079,348 A * 6/2000 Rudolph ..... 114/315
6,089,178 A * 7/2000 Yamamoto et al. ..... 114/337
6,692,317 B2 * 2/2004 Poissonniere ..... 440/15
6,941,884 B2 9/2005 Moore
6,974,356 B2 * 12/2005 Hobson et al. ..... 440/13
2004/0229531 A1 * 11/2004 Driscoll et al. ..... 441/23

OTHER PUBLICATIONS

Promode R. Bandyopadhyay, Maneuvering Hydrodynamics of Fish and Small Underwater Vehicles, Article 2002, pp. 102-117, vol. 42, No. 1, Integrative and Comparative Biology, USA.
Promode R. Bandyopadhyay, Experimental Simulation of Fish-Inspired Unsteady Vortex Dynamics on a Rigid Cylinder, Article, Jun. 2000, pp. 219-238, vol. 122, ASME, Journal of Fluids Engineering, USA.
John D. W. Madden et al., Artificial Muscle Technology; Physical Principles and Naval Prospects, Article, Jul. 2004, pp. 706-728, vol. 29, No. 3 IEEE Journal of Oceanic Engineering, USA.
John D. W. Madden et al., Application of Polypyrrole Actuators; Feasibility of Variable Camber Foils, Article, Jul. 2004, pp. 738-749, vol. 29, No. 3, IEEE Journal of Oceanic Engineering, USA.

(Continued)

*Primary Examiner*—Stephen Avila
(74) *Attorney, Agent, or Firm*—James M. Kasischke; Michael P. Stanley; Jean-Paul A. Nasser

(57) ABSTRACT

A linear actuator is provided that converts linear motion to oscillatory motion. The linear actuator includes flats, a hinge, and linear actuators. A hydrofoil is mountable on a spindle attached to the hinge. In operation, a linear push direction by the linear actuator drive causes the hydrofoil to rotate in an oscillating manner. A linear push by another linear actuator drive reverses the oscillation directions of the hydrofoil. The flats are preferably made of flexible strip metal to easily transmit motion to the spindle. The hydrofoil and spindle combine to a slot for smooth transmission of linear to oscillatory motion.

4 Claims, 3 Drawing Sheets

OTHER PUBLICATIONS

Jason W. Paquette et al., Ionomeric Electroactive Polymer Artifical Muscle for Naval Applications, Article, Jul. 2004, pp. 729-737, vol. 29, No. 3, IEEE Journal of Oceanic Engineering, USA.

Promode R. Bandyopadhyay, A Biomimetic Propulsor for Active Noise Control; Exmperiments, Article, Mar. 2002, pp. 1-15, Naval Undersea Warfare Center, USA.

Michael H. Dickinson et al., Wing Rotation and the Aerodynamic Basis of Insect Flight, Article, Jun. 1999, pp. 1954-1960, vol. 284 Science, USA.

S. Sunada et al., Unsteadly Forces on a Two-Dimensional Wing in Plunging and Pitching Motions, Article, Jul. 2001, pp. 1230-1239, vol. 39 No. 7, AIAA Journal, USA.

C.P. Ellington, The Aerodynamics of Hovering Insect Flight. IV. Aerodynamic Mechanisms, Article Feb. 24, 1984. pp. 79-113, vol. 305, Issue 1122, Philosophical Transactions of the Royal Society of London, Great Britain.

Promode R. Bandyopadhyay, Guest Editorial: Biology-Inspired Science and Technology for Autonomous Underwater Vehicles, Article, Jul. 2004, pp. 542-546, vol. 29, No. 3, IEEE Journal of Oceanic Engineering, USA.

Promode R. Bandyopadhyay, Trends in Biorobotic Autonomous Undersea Vehicles, Article, Jan. 2005, pp. 109-139, vol. 30, No. 1, IEEE Journal of Oceanic Engineering, USA.

* cited by examiner

LINEAR ACTUATOR FOR FLAPPING HYDROFOIL

STATEMENT OF GOVERNMENT INTEREST

The invention described herein may be manufactured and used by or for the Government of the United States of America for Governmental purposes without the payment of any royalties thereon or therefore.

BACKGROUND OF THE INVENTION (1) Field of the Invention

The present invention relates to propulsors, specifically to a linear actuator that produces oscillatory motion. The oscillatory motion is employed by flapping hydrofoils used in propulsors for undersea vehicles.

(2) Description of the Prior Art

It is known in the art that there are significant differences between heaving-pitching foil propulsion and conventional propulsion. The design of current underwater propulsors is based on steady-state hydrodynamic and aerodynamic theories as well as experimental knowledge. This is true of aircraft and undersea vehicles with this branch of engineering reaching a high level of maturity.

Further improvement in conventional propulsion will be incremental if the basic mechanism of production of lift on a hydrofoil remains largely the same. Conversely, if new and powerful mechanisms of lift production can be found and computational methods of hydrofoil blade design for implementing those mechanisms can be developed; new material technologies, control theories, and information processing architecture can be implemented.

For heaving-pitching foil propulsion, a flapping hydrofoil is used. In operation, the hydrofoil moves about an axis transverse to the direction of vehicle movement as does a rudder, but the hydrofoil oscillates so as to generate vortices about axes transverse to this direction. A single hydrofoil may be used or a plurality of hydrofoils variously moving toward or from each other may be used. The hydrofoil movements, and phases of multiple hydrofoils, may be variously intermittent, may be altered in frequency and amplitude, or may be asymmetric. These variations are advantageously selected for conditions when wake detection or reduction is not important, when a vehicle speed changes, or when the vehicle maneuvers.

Based on neural mechanics, a significant improvement in the development of quieter heaving-pitching propulsors is likely. Research into biology rather than physics indicates the feasibility that complex active systems can indeed be miniaturized and can be functional competitive.

Based on steady-state hydrodynamics and aerodynamics, flying insects like fruit flies are not supposed to fly; yet the insects do. It has been shown, using scaled up models of flying insects like fruit flies, that the fruit flies possess three mechanisms of lift enhancement. These lift mechanisms are based on unsteady hydrodynamics and not steady-state hydrodynamics.

First, the lift mechanisms produce vortices at the leading and trailing edges of the wings of the fruit flies. This dynamic stall delays conventional stall and allows higher levels of lift forces to be produced. Second, a rotational effect occurs due to wing rotation. It has also been shown that efficiency is highest and maximum lift is produced when the center of rotation is at about the quarter chord point from the leading edge. The third lift mechanism is wake or vortex capture.

As such, an improvement to propulsion would be to help apply the effects of the lift mechanisms, one or two or all three of the effects. The improved mechanisms could be used with undersea vehicles to enhance the lift produced by propulsion blades and the rotational speed (RPM=revolutions per minute) can thus be reduced.

As is also known in the art, there are three sources of propulsion radiated noise coming from a rotor blade. The first source of propulsion radiated noise is due to the ingestion of upstream vehicle turbulence by the rotor blade. The second source of propulsion radiated noise is blade tonals due to the gust created by a rotor blade shearing through the wake of the upstream stator blade. The third source of propulsion radiated noise is trailing edge vibration.

These three sources of propulsion radiated noise are proportional to the $4^{th}$, $5^{th}$ and $6^{th}$ power of RPM. When the RPM is reduced, the noise due to all these three sources, are reduced. In heaving and pitching propulsion, frequencies are $1/100^{th}$ or even less than those in "conventional" propulsors.

As such, an improvement in decreasing radiated noise would be to go further than simply applying a heaving and pitching mechanism. One such improvement would be implementing the heaving and pitching mechanism in an even quieter manner by the use of an improved actuator.

Presently, the oscillatory motion of actuators is produced by servo-gear drives, which tend to have a modest efficiency. Thus, there is also a need for more efficient mechanisms for producing oscillatory motions in hydrofoils. More importantly, even apart from efficiency, servo-gear drives produce noise and vibration in the hull, which in turn radiates noise. As such, there is a need to lower such drive noise and vibration.

SUMMARY OF THE INVENTION

Accordingly, it is a general purpose and primary object of the present invention to provide a device that converts linear motion to oscillatory motion.

It is a further object of the present invention to provide a device that produces oscillatory motion for flapping hydrofoils.

It is further object of the present invention to provide a device that produces oscillatory motion in a quiet manner.

In order to attain the objects described, there is provided a linear actuator of the present invention. The linear actuator generally includes flats, a hinge, and linear drives. A hydrofoil is mounted on a spindle attached to the hinge. In operation, a linear push direction by the linear actuator drive causes the hydrofoil to rotate in an oscillating manner. A linear push by another linear actuator drive reverses the oscillation directions of the hydrofoil. The flats are preferably made of flexible strip metal to easily transmit motion to the spindle. The hydrofoil and spindle combine to a slot for smooth transmission of linear to oscillatory motion. The linear actuator lowers radiated noise of undersea vehicles due the elimination of servos with gear drives for producing heaving and pitching motion. Also, the linear actuator has the potential to be free of backlash—common in gear drives due to wear and tear of the gear drives in use.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE PREFERRED EMBODIMENT

Figure 1:
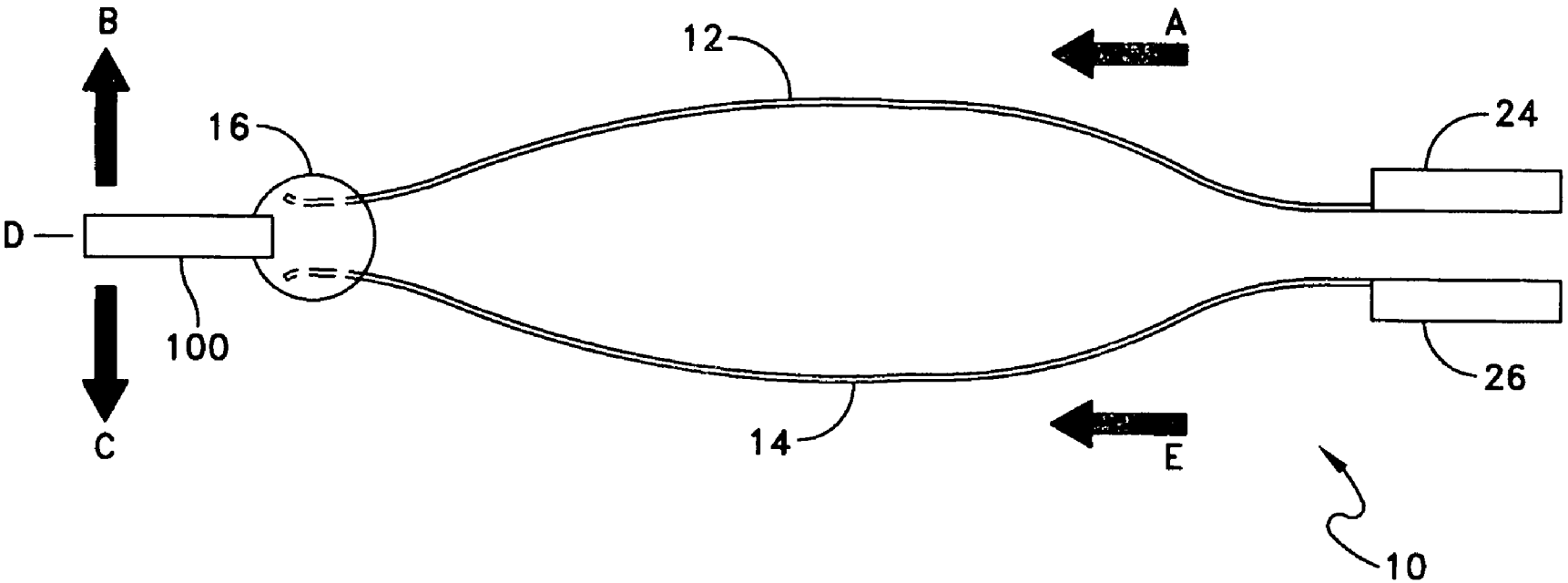
FIG. 1 is a schematic of the operation of the linear actuator of the present invention.

Referring now to the drawings wherein like numerals refer to like elements throughout the several views, one sees that FIG. 1 schematically depicts a linear actuator 10 of the present invention. The linear actuator 10 generally includes flats 12 and 14, a hinge 16 and linear actuators 24, 26. A hydrofoil 100 is mounted on a spindle 28 attached to the hinge 16.

In operation, linear push direction of "A" by the linear actuator drive 24 causes the hydrofoil 100 to rotate in an oscillating manner, as shown by directions "B", "C", and "D". A linear push of direction "E" by the linear actuator drive 26 reverses the oscillation directions of the hydrofoil 100. The absence of a gear drive is notable in FIG. 1.

Figure 2:
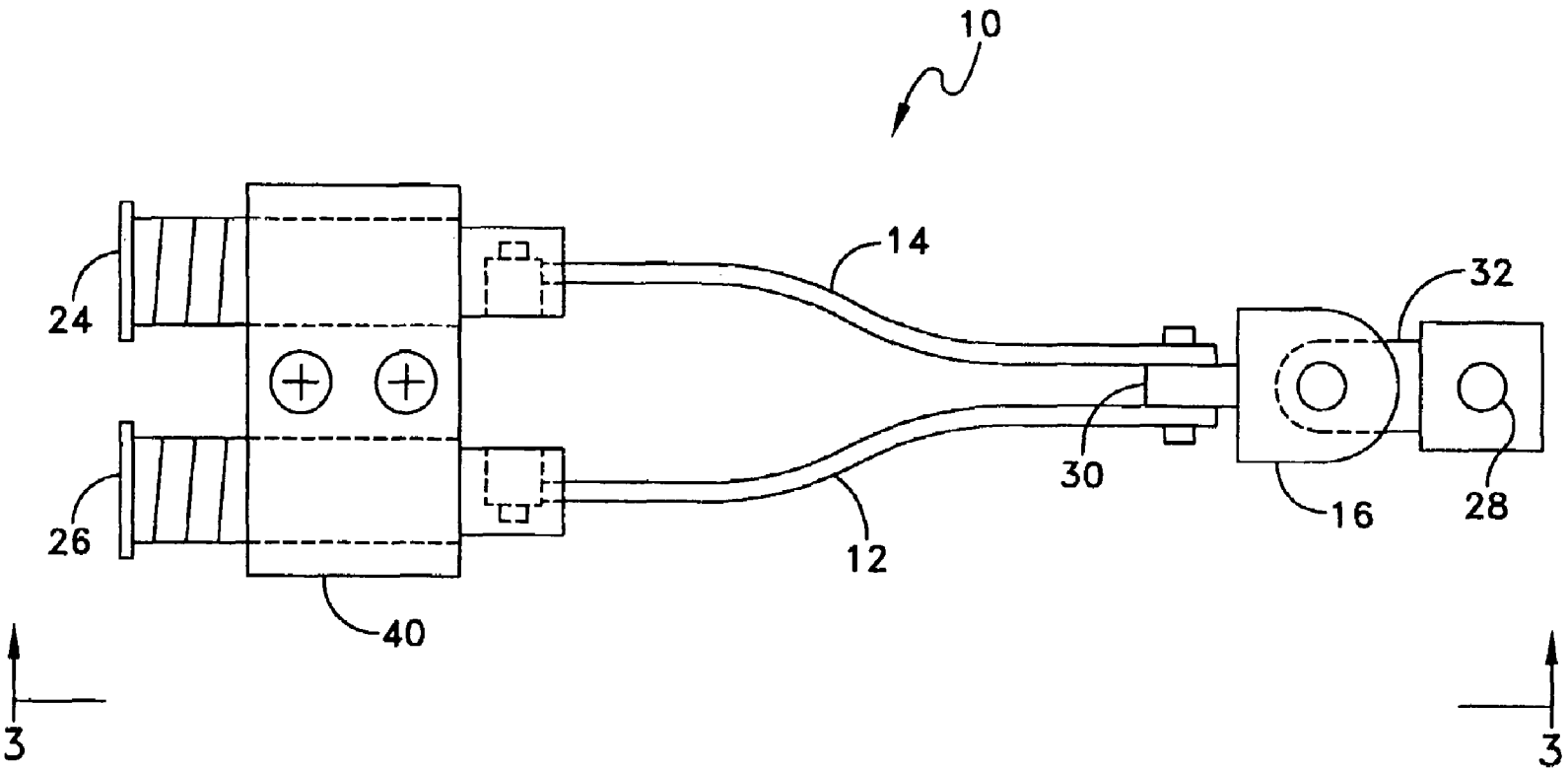
FIG. 2 depicts the linear actuator of the present invention.
Figure 3:
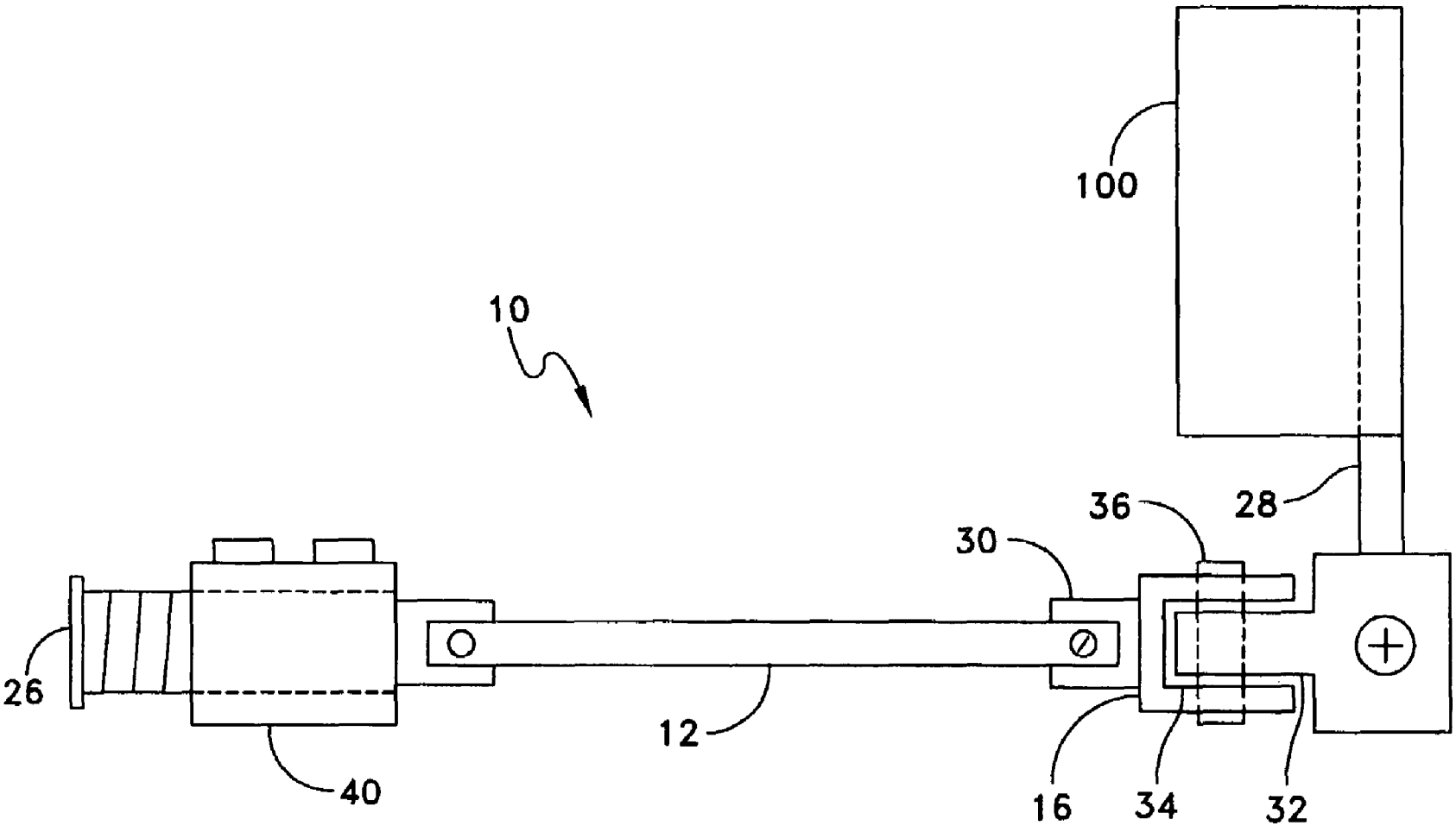
FIG. 3 is an alternate view of the linear actuator of the present invention with the view taken from reference line 3-3 of FIG. 2.

Construction of the linear actuator 10 is shown in FIG. 2 and FIG. 3. In the figures, the flats 12 and 14 merge into and mechanically attach to a divider block 30 before the hinge 16 where the spindle 28 is centrally positioned. The flats 12 and 14 are preferably made of flexible strip metal to easily transmit motion to the spindle 28; however, other flexible materials known to those skilled in the art may be used. A similar block 32 from the spindle 28 meets the block 30 and at the merging point, there is a slot 34 to allow unobstructed motion transmission between the linkages of the blocks.

FIG. 3 depicts the two blocks 30, 32 with the flat 12 shown. The hydrofoil 100 and spindle 28 combine to the slot 34 for smooth transmission of linear to oscillatory motion. Pin 36 resides inside the slot 34 and moves to directions B and C as the flats 12 and 14 are alternately pushed by the linear actuators 24 and 26. These alternate pushes by the linear actuator 24, 26 through bushing 40 provide the oscillatory motion to the hydrofoil 100.

The linear actuator 10 of the present invention lowers radiated noise of undersea vehicles due the elimination of servos with gear drives for producing heaving and pitching motion. Also, the linear actuator 10 has the potential to be free of backlash—common in gear drives due to wear and tear of the gear drives in use.

Furthermore, the linear actuator 10 has the potential to be lighter and free of mechanical mechanisms, by the use of artificial muscles and electrically operated by the use of electrodes and operationally similar electro-active polymers.

Still further, the linear actuator 10 has the potential to utilize linear electromechanical drives which have less mechanical friction compared to gear drives that motors and servos utilize.

The foregoing description of the preferred embodiment of the invention has been presented for purposes of illustration and description only. It is neither intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. A device for producing oscillatory motion from linear motion, said device comprising:

a first spring actuator;

a second spring actuator;

a bushing mechanically having a first path through which said first spring actuator is movably positioned and having a second path through which said second spring actuator is movably positioned;

a hinge including a divider in which a second end of a first flat and a second end of a second flat are attached on opposite sides of said divider;

a first flat elongated strip with a first end attached to said first spring actuator and a second end attached on one side of said divider wherein said first flat elongated strip transmits linear motion by flexible movement of said first flat elongated strip from said first spring actuator from the first end in a direction impacting to an axis of said hinge such that said hinge rotates in an oscillatory direction thereby rotating a spindle in an oscillatory direction; and a second flat elongated strip with a first end attached to second spring actuator and a second end attached on another side of said divider wherein said second flat elongated strip transmits the linear motion from said second spring actuator by flexible movement of said second flat elongated strip in a direction impacting to an axis of the said hinge such that said hinge rotates in another oscillatory direction opposite to the oscillatory direction produced by said first flat elongated strip thereby rotating said spindle in the opposite oscillatory direction.

2. The device in accordance with claim 1 wherein said spindle is mechanically attachable to a hydrofoil thereby producing the oscillatory motion of the hydrofoil.

3. The device in accordance with claim 2 wherein said first flat and said second flat are flexible steel.

4. The device in accordance with claim 1 wherein said first flat and said second flat are flexible steel.

* * * * *